US011827491B2

(12) United States Patent
Simcik et al.

(10) Patent No.: US 11,827,491 B2
(45) Date of Patent: Nov. 28, 2023

(54) ELEVATOR SERVICE REQUEST USING USER DEVICE

(71) Applicant: Otis Elevator Company, Farmington, CT (US)

(72) Inventors: Paul A Simcik, Southington, CT (US); Gary Pisarsky, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1305 days.

(21) Appl. No.: 16/063,801

(22) PCT Filed: Dec. 20, 2016

(86) PCT No.: PCT/US2016/067753

§ 371 (c)(1),
(2) Date: Jun. 19, 2018

(87) PCT Pub. No.: WO2017/112659

PCT Pub. Date: Jun. 29, 2017

(65) Prior Publication Data

US 2020/0262679 A1 Aug. 20, 2020

Related U.S. Application Data

(60) Provisional application No. 62/271,070, filed on Dec. 22, 2015.

(51) Int. Cl.

| | |
|---|---|
| ***B66B 1/34*** | (2006.01) |
| ***B66B 1/46*** | (2006.01) |
| ***B66B 1/24*** | (2006.01) |

(52) U.S. Cl.

CPC ..... *B66B 1/468* (2013.01); *B66B 1/2408* (2013.01); *B66B 1/3461* (2013.01); (Continued)

(58) Field of Classification Search

CPC ..... B66B 1/468; B66B 13/02; B66B 13/146; B66B 13/22; B66B 2201/4676; B66B 2201/4684

See application file for complete search history.

(56) References Cited

U.S. PATENT DOCUMENTS

| | | | |
|---|---|---|---|
| 6,481,536 | B2 | 11/2002 | Pfeffer |
| 6,868,945 | B2 | 3/2005 | Schuster et al. |

(Continued)

FOREIGN PATENT DOCUMENTS

| | | | |
|---|---|---|---|
| CN | 101238057 | A | 8/2008 |
| CN | 104058308 | A | 9/2014 |

(Continued)

OTHER PUBLICATIONS

International Search Report, International Application No. PCT/US2016/067753, dated Mar. 15, 2017, European Patent Office; International Search Report 4 pages.

(Continued)

*Primary Examiner* — Christopher Uhlir

(74) *Attorney, Agent, or Firm* — CANTOR COLBURN LLP

(57) ABSTRACT

Methods and systems for elevator control are provided. The methods and systems include receiving, by a computing device comprising a processor, a request for at least one service associated with an elevator system from a user device, controlling an elevator car to travel to a specific floor in accordance with the request, controlling an elevator car door to be closed upon arriving at the specific floor, transmitting an indicator to the user device that the elevator car has arrived at the specific floor, and controlling the elevator car door to open upon receiving, by the computing device, an access request from the user device.

13 Claims, 5 Drawing Sheets

(52) U.S. Cl.
CPC . *B66B 2201/405* (2013.01); *B66B 2201/4615* (2013.01); *B66B 2201/4653* (2013.01)

(56) References Cited

U.S. PATENT DOCUMENTS

| | | | | |
|---|---|---|---|---|
| 6,986,408 | B2 | 1/2006 | Takeuchi | |
| 7,377,364 | B2 | 5/2008 | Tyni et al. | |
| 7,552,800 | B2 * | 6/2009 | Puskala | B66B 1/468 187/392 |
| 8,151,942 | B2 | 4/2012 | Rusanen et al. | |
| 8,573,366 | B2 * | 11/2013 | Elomaa | B66B 1/2458 187/387 |
| 8,744,754 | B2 | 6/2014 | Kappeler et al. | |
| 9,045,314 | B2 * | 6/2015 | Finschi | B66B 1/468 |
| 9,957,132 | B2 * | 5/2018 | Berryhill | B66B 1/468 |
| 10,106,371 | B2 * | 10/2018 | Hanninen | B66B 1/468 |
| 10,273,117 | B2 * | 4/2019 | Buckman | G06Q 10/1093 |
| 2008/0196979 | A1 | 8/2008 | Susumu | |
| 2008/0217112 | A1 * | 9/2008 | Puskala | B66B 1/468 187/392 |
| 2008/0236956 | A1 | 10/2008 | Finschi | |
| 2012/0018257 | A1 * | 1/2012 | Tokura | B66B 1/468 187/387 |
| 2012/0228065 | A1 * | 9/2012 | Tokura | B66B 1/468 187/384 |
| 2013/0048436 | A1 * | 2/2013 | Chan | B66B 1/2408 187/387 |
| 2013/0133986 | A1 | 5/2013 | De Vincentis et al. | |

FOREIGN PATENT DOCUMENTS

| | | | |
|---|---|---|---|
| JP | 01209288 | A | 8/1989 |
| JP | 03297767 | A | 12/1991 |
| JP | 0551174 | A | 3/1993 |
| JP | 06211449 | A | 8/1994 |
| WO | 02066357 | A1 | 8/2002 |
| WO | 2014116182 | A1 | 7/2014 |
| WO | 2015084396 | A1 | 6/2015 |
| WO | 2015121294 | A1 | 8/2015 |

OTHER PUBLICATIONS

International Written Opinion, International Application No. PCT/US2016/067753, dated Mar. 15, 2017, European Patent Office; International Search Report 6 pages.

* cited by examiner 414
422
8:39
Floor 7
Request Elevator
Cancel
420
424
426

414
422
8:39
Floor 7
Please wait for your elevator
Elevator Requested
Cancel
420
424
426

414
422
8:39
Floor 7
Elevator C has arrived
Request Access
Cancel
420
424
426

ELEVATOR SERVICE REQUEST USING USER DEVICE

CROSS REFERENCE TO RELATED APPLICATIONS

This is a U.S. National Stage of Application No. PCT/US2016/067753, filed on Dec. 20, 2016, which claims the benefit of U.S. Provisional Patent Application No. 62/271,070, filed on Dec. 22, 2015, the disclosures of which are incorporated herein by reference.

BACKGROUND

The subject matter disclosed herein generally relates to elevator service requests for elevators and, more particularly, to elevator service requests using user devices.

Conventionally, an elevator system recognizes the existence of individual users planning to use the elevator in order to respond to demand or requests for service. Control panels, including but not limited to buttons, keypad devices, and touchscreen devices may be used for entering a request for elevator service. For example, an elevator system may utilize a two-button control panel configuration (e.g., up and down buttons), wherein a direction of travel within the elevator system is requested by pressing one of the two buttons. An elevator system may utilize a keypad and/or touchscreen device with destination dispatching, such that a user may specify a floor or landing that the user would like to be taken to as part of the request for service. In either case/configuration, a user/passenger engages in an affirmative action to request elevator service by using devices available at an elevator landing, i.e., where the elevator is called and entered/exited by passengers.

Current VIP related features for elevator access control result in an elevator arriving at a requested floor and leaving doors open while waiting for VIPs to enter. The VIPs must authorize access with button pushes or card readers to activate an elevator to provide service. As such, occasionally, individuals in the building can accidentally board an elevator requested by and/or reserved for a VIP.

BRIEF SUMMARY

According to one embodiment, a method for controlling an elevator is provided. The method includes receiving, by a computing device comprising a processor, a request for at least one service associated with an elevator system from a user device, controlling an elevator car to travel to a specific floor in accordance with the request, controlling an elevator car door to be closed upon arriving at the specific floor, transmitting an indicator to the user device that the elevator car has arrived at the specific floor, and controlling the elevator car door to open upon receiving, by the computing device, an access request from the user device.

In addition to one or more of the features described herein, or as an alternative, further embodiments of the method may include validating the request based on a profile associated with the user device and contained within the request.

In addition to one or more of the features described herein, or as an alternative, further embodiments of the method may include obtaining, by the computing device, profile and/or registration information associated with a plurality of user devices.

In addition to one or more of the features described herein, or as an alternative, further embodiments of the method may include that the request includes location information of the user device.

In addition to one or more of the features described herein, or as an alternative, further embodiments of the method may include receiving information related to a destination floor with the request.

In addition to one or more of the features described herein, or as an alternative, further embodiments of the method may include releasing the elevator car when an access request is not received within a predetermined period of time.

In addition to one or more of the features described herein, or as an alternative, further embodiments of the method may include that the predetermined period of time is contained within the request.

In addition to one or more of the features described herein, or as an alternative, further embodiments of the method may include that the notification indicates a specific elevator has arrived.

In addition to one or more of the features described herein, or as an alternative, further embodiments of the method may include that request identifies a specific elevator to be used and wherein the controlled elevator is the specific elevator.

According to another embodiment, a controller for an elevator system is provided. The controller includes at least one processor and memory having instructions stored thereon that, when executed by the at least one processor, cause the controller to control an elevator car to travel to a specific floor in accordance with the request when a request for at least one service associated with the elevator system is received from a user device, control an elevator car door to be closed upon arriving at the specific floor, transmit an indicator to the user device that the elevator car has arrived at the specific floor, and control the elevator car door to open upon receiving an access request from the user device.

In addition to one or more of the features described herein, or as an alternative, further embodiments of the controller may include causing the controller to validate the request based on a profile associated with the user device and contained within the request.

In addition to one or more of the features described herein, or as an alternative, further embodiments of the controller may include causing the controller to obtain profile and/or registration information associated with a plurality of user devices.

In addition to one or more of the features described herein, or as an alternative, further embodiments of the controller may include that the request includes location information of the user device.

In addition to one or more of the features described herein, or as an alternative, further embodiments of the controller may include that a destination floor is indicated in the request, the controller configured to control the elevator car to the destination floor after receiving the access request.

In addition to one or more of the features described herein, or as an alternative, further embodiments of the controller may include that, when an access request is not received within a predetermined period of time, the controller is configured to release the elevator car.

In addition to one or more of the features described herein, or as an alternative, further embodiments of the controller may include that the notification indicates a specific elevator has arrived.

In addition to one or more of the features described herein, or as an alternative, further embodiments of the controller may include that request identifies a specific elevator to be used and wherein the controlled elevator is the specific elevator.

Technical effects of embodiments of the present disclosure include employing a user device to communicate a VIP request to an elevator system. Further, access rights for the owner of the user device may be provided when the user device is registered with local building management, i.e., input into an elevator control system. The system may announce arrival of a VIP-elevator car through the user device and the elevator car may be configured to wait with the elevator car doors fully closed. The user of the user device may acknowledge that a VIP is ready to board the elevator car by pressing a button presented on a user device display. The elevator doors may open and the VIP/user may travel to a predefined destination that may be entered via the user device.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
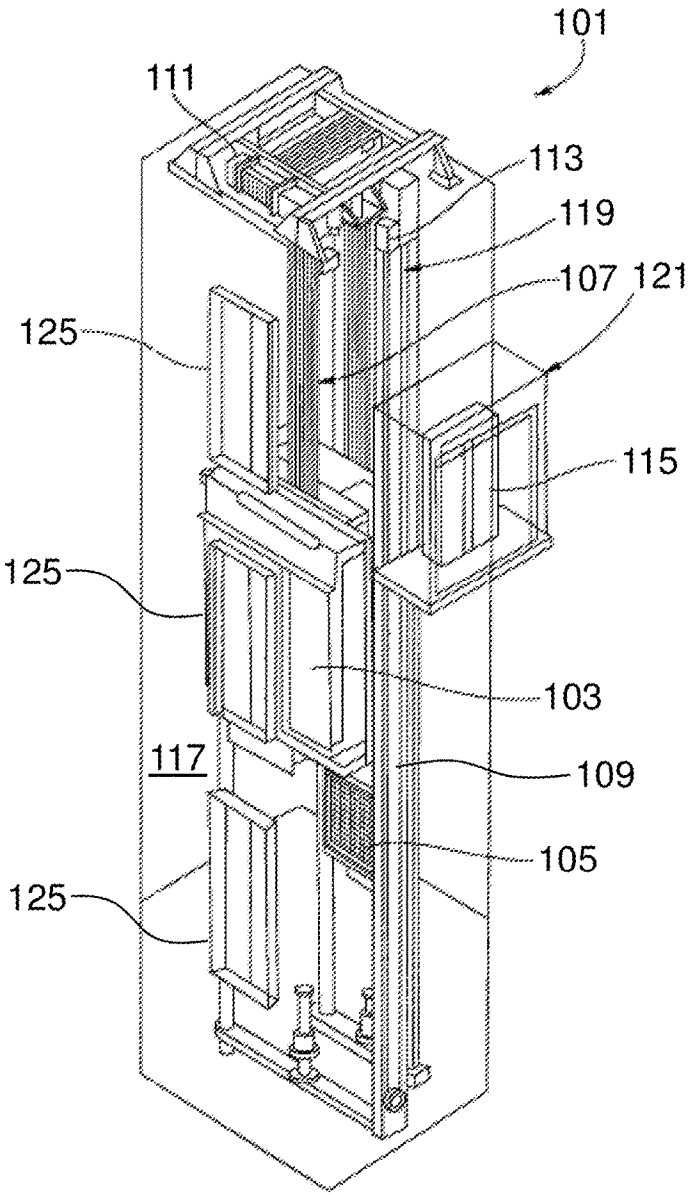
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Embodiments provided herein are direct to apparatuses, systems, and methods for fulfilling a request for service, such as a request for elevator service. In some embodiments, a request for elevator service may be communicated over one or more lines, connections, or networks, such as one or more cellular networks, e.g. a request made by a user device such as a smart phone. The request for service may be initiated by a mobile device controlled by and/or associated with a user, in a passive or active manner. In some embodiments, the mobile device may be operative in conjunction with a Transmission Control Protocol (TCP) and/or a User Datagram Protocol (UDP). In some embodiments, a request for service may be authenticated or validated based on a location of the mobile device. In some embodiments, a request for service may be fulfilled in accordance with one or more profiles, such as one or more user or mobile device profiles. In some embodiments the profiles may be registered as part of a registration process. In some embodiments, an elevator system may be registered with a service provider.

Figure 2:
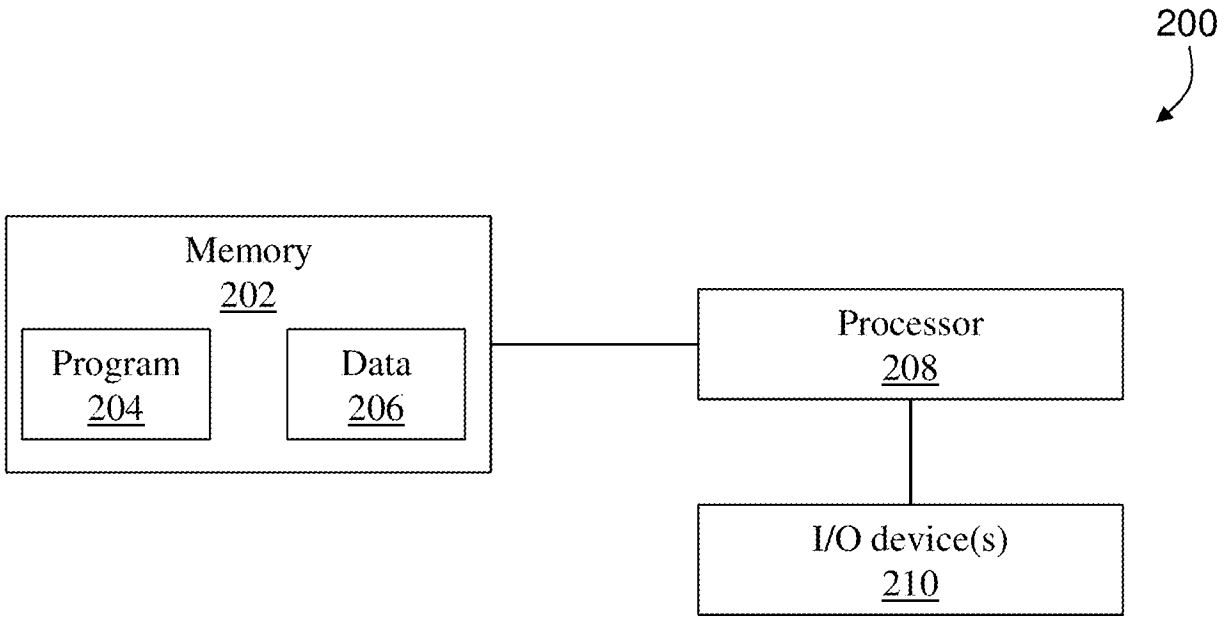
FIG. 2 is a schematic block diagram illustrating a computing system that may be configured one or more embodiments of the present disclosure.

Referring now to FIG. 2, an exemplary computing system 200 is shown. The computing system 200 may be configured as part of and/or in communication with an elevator controller, e.g., controller 115 shown in FIG. 1. The system includes a memory 202 which may store executable instructions and/or data. The executable instructions may be stored or organized in any manner and at any level of abstraction, such as in connection with one or more applications, processes, routines, procedures, methods, etc. As an example, at least a portion of the instructions are shown in FIG. 2 as being associated with a program 204.

Further, as noted, the memory 202 may store data 206. The data 206 may include profile or registration data, elevator car data, a device identifier, or any other type(s) of data. The instructions stored in the memory 202 may be executed by one or more processors, such as a processor 208. The processor 208 may be operative on the data 206.

The processor 208 may be coupled to one or more input/output (I/O) devices 210. In some embodiments, the I/O device(s) 210 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, etc. The I/O device(s) 210 may be configured to provide an interface to allow a user to interact with the computing system 200. For example, the I/O device(s) may support a graphical user interface (GUI) and/or voice-to-text capabilities.

The components of the computing system 200 may be operably and/or communicably connected by one or more buses. The computing system 200 may further include other features or components as known in the art. For example, the computing system 200 may include one or more transceivers and/or devices configured to receive information or data from sources external to the computing system 200. For example, in some embodiments, the computing system 200 may be configured to receive information over a network (wired or wireless). The information received over a network may be stored in the memory 202 (e.g. as data 206) and/or may be processed and/or employed by one or more programs or applications (e.g., program 204).

The computing system 200 may be used to execute or perform embodiments and/or processes described herein. For example, the computing system 200, when configured as part of an elevator control system, may be used to receive commands and/or instructions, and may further be configured to control operation of and/or reservation of elevator cars within one or more elevator shafts.

Figure 3:
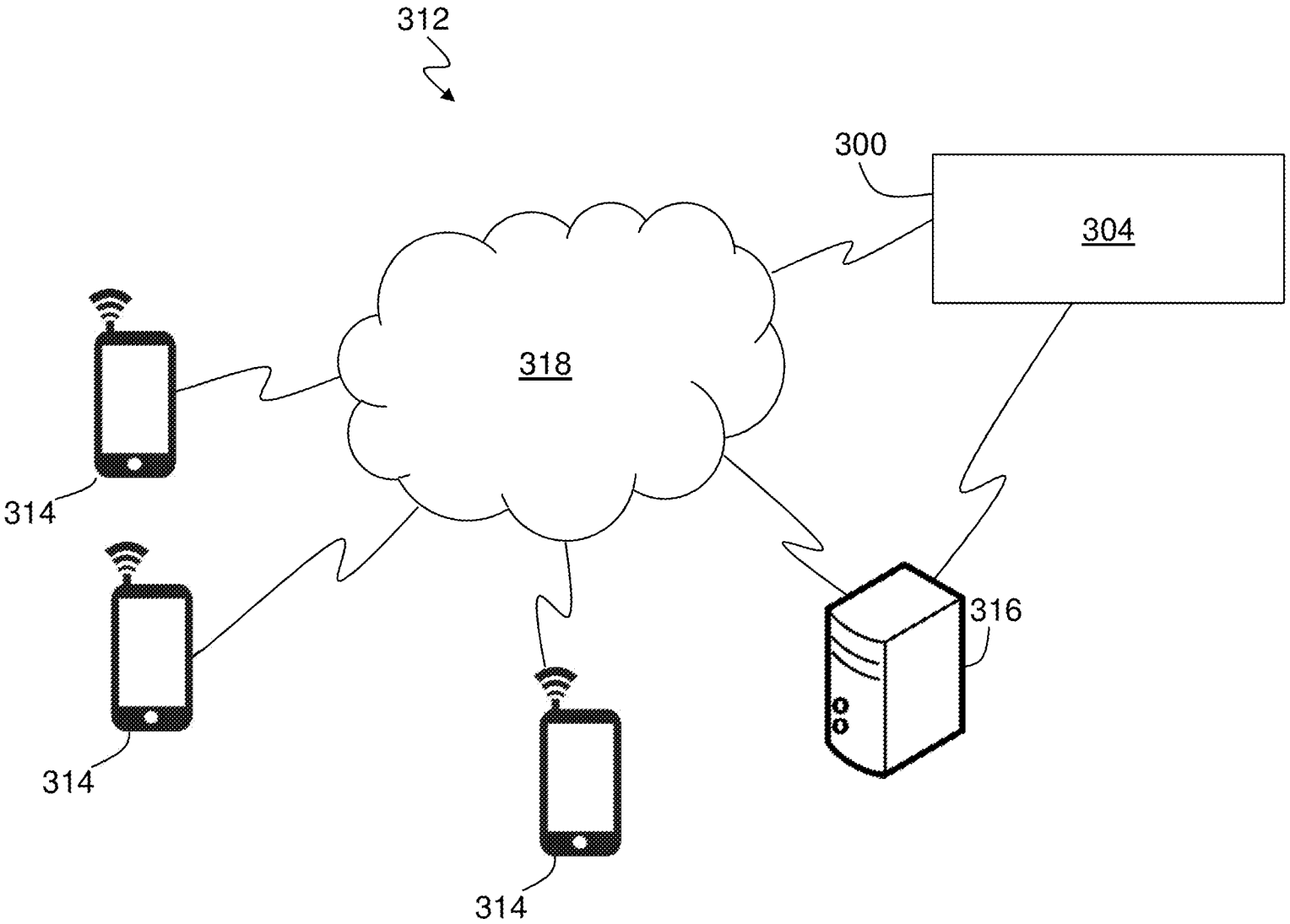
FIG. 3 illustrates a schematic block diagram of a system configured in accordance with an embodiment of the present disclosure.

Referring to FIG. 3, a block diagram of an elevator control system 312 for enabling control of an elevator system pertaining to a discussion in accordance with an embodiment is shown. The system 312 includes an elevator reservation and control program or application for performing the processing described herein that is executed by one or more computer programs located on a computing system 300 and/or one or more user systems 314, 316. The computing system 300 of FIG. 3 may be configured as a computing system similar to computing system 200 shown in FIG. 2.

The elevator control system 312 depicted in FIG. 3 includes one or more user systems 314, 316 through which users, e.g., users and passengers of an elevator system. The user systems 314, 316 are coupled to the computing system 300 via a network 318. Each user system 314 may be implemented using a general-purpose computer executing a computer program for carrying out the processes described herein. The user systems 314, 316 may be user devices such as personal computers (e.g., a laptop, a tablet computer, a cellular telephone, etc.) or host attached terminals. If the user systems 314, 316 are personal computers, in some embodiments, the processing described herein may be shared by a user system 314, 316 and the host system 300. The user systems 314, 316 may also include game consoles, smartphones, tablets, wearable electronic devices, network management devices, and field programmable gate arrays.

The network 318 may be any type of known network including, but not limited to, a wide area network (WAN), a local area network (LAN), a global network (e.g. Internet), a virtual private network (VPN), a cloud network, and an intranet. The network 318 may be implemented using a wireless network or any kind of physical network implementation known in the art. A user system 314, 316 may be coupled to the computing system 300 through multiple networks 318 (e.g., cellular and Internet) so that not all user systems 314, 316 are coupled to the computing system 300 through the same network 318. One or more of the user systems 314 and the computing system 300 may be connected to the network 318 in a wireless fashion. In one non-limiting embodiment, the network is the Internet and one or more user systems 314 execute a user interface application (e.g. a web browser) to contact the computing system 300 through the network 318. In another non-limiting example embodiment, a user system 316 may be connected directly (i.e., not through the network 318) to the computing system 300.

As noted, the computing system 300 may be associated with an elevator system (e.g., elevator system 101 and in communication with or part of controller 115 of FIG. 1). The computing system 300 may be used to process or fulfill requests for elevator service.

The requests for elevator service may be received through the network 318 from one or more user devices 314, 316, which may be mobile devices, including, but not limited to phones, laptops, tablets, smartwatches, etc. One or more of the user devices 314 may be associated with (e.g., owned by) a particular user. The user may use his/her user device(s) 314, 316 to request a service, such as an elevator service.

For example, a user of a user device 314 may request service in an affirmative or active manner. For example, the user may enter an explicit request for elevator service using an I/O interface of the user device 314. That is, in some embodiments, an app or other program may be installed and operated on a user device 314 wherein the user may interact with the app or other program to request elevator service.

In other embodiments, or in combination therewith, the user may request elevator service in a passive manner. For example, a profile may be established for the user or the particular user device 314, 316, optionally as part of a registration process with, e.g., a service provider. The profile may contain a log of the user's history and/or activities, such as where the user has gone or traveled to, the user's preferences, or any other data that may be applicable to the user. The profile may be accessed or analyzed to determine the likelihood or probability that the user will request elevator service at a particular moment in time (e.g., a particular day or time of day). Resources may be provisioned or allocated to fulfill the request (e.g., an elevator car call or reservation may be placed) in the event that the probability of requested service, or consumption, or use of an elevator is anticipated.

The request for service may be conveyed or transmitted from the user device 314, 316 through the network 318. For example, the request for service may be transmitted to and/or over the Internet and/or a cellular network. The network(s) may include infrastructure that may be organized to facilitate cloud computing. For example, one or more servers, such as a primary message server, a backup message server, and a device commissioning message server may be employed as part of the network 318.

In some embodiments, the request for service may specify a type of service requested, at any level of detail or abstraction. For example, a first request for service may specify that elevator service is requested, a second request for service may specify one or more of a departure floor and/or a destination floor, and a third request for service may specify that elevator service is desired to accommodate a heavy load (e.g., freight or cargo) with a number of other users or passengers in an amount less than a threshold. In some embodiments, the request for service transmitted from the user device 314, 316 may include an identifier associated with the user or the particular user device 314, 316 in order to allow, e.g., the computing system 300 to distinguish between users and/or user devices 314, 316.

The computing system 300 (and program 304 stored thereon) may be configured to process requests for service received from one or more mobile devices 314, 316. As part of the processing, the computing system 300 may validate or authenticate a user device 314, 316 and/or a user, potentially based on an identifier associated with the user and/or the user device 314, 316. The validation may be based on a location of the user and/or the user device 314, 316. The location may be determined based on one or more location-based services or techniques, such as triangulation, global positioning system (GPS), network connection, Wi-Fi connection, etc. In some embodiments, the user may need to be within a threshold distance of a location (e.g., a building) where the requested service (e.g., elevator service) is provided in order for a service request to be approved and/or processed.

A profile for a user and/or user device 314, 316 may maintain a log or count of the number of times a service request for the user/user device 314, 316 has been approved and/or a count of the number of times a service request for the user/user device 314, 316 has been disapproved. If the number of disapprovals (or the ratio of disapprovals to approvals) exceeds a threshold, future requests for service from the user/user device 314, 316 may be denied in order to help minimize abusive practices/requests.

If a service request is validated or approved by, e.g., the computing system 300, the service request may be transmitted from the computing system 300 to one or more controllers, such as one or more elevator controllers (e.g., controller 115). The controllers may be configured to communicate with the computing system 300 and/or one another to fulfill service requests. In this respect, it should be noted that service requests might not only originate from user device 314, 316 but may also originate locally (e.g., within a building in which the controllers may be located or in which the requested service(s) may be provided). The controllers may select a resource (e.g., an elevator system or elevator car) that is suited to fulfill a service request, potentially based on one or more considerations, such as power consumption/efficiency, quality of service (e.g., reduction in waiting time until a user or passenger arrives at a destination floor or landing), etc. In some embodiments, the computing system 300 may select the resource to fulfill a service request, and such a selection may be transmitted by the computing system 300 to one or more of the controllers.

In some embodiments, one or more of the controllers and/or the computing system 300 may be registered with a service provider. The service provider may be responsible for accepting and processing (e.g., validating or approving/disapproving) service requests and routing (approved) service requests to an appropriate entity (e.g., one or more elevator controllers).

Figures 4A, 4B, 4C:
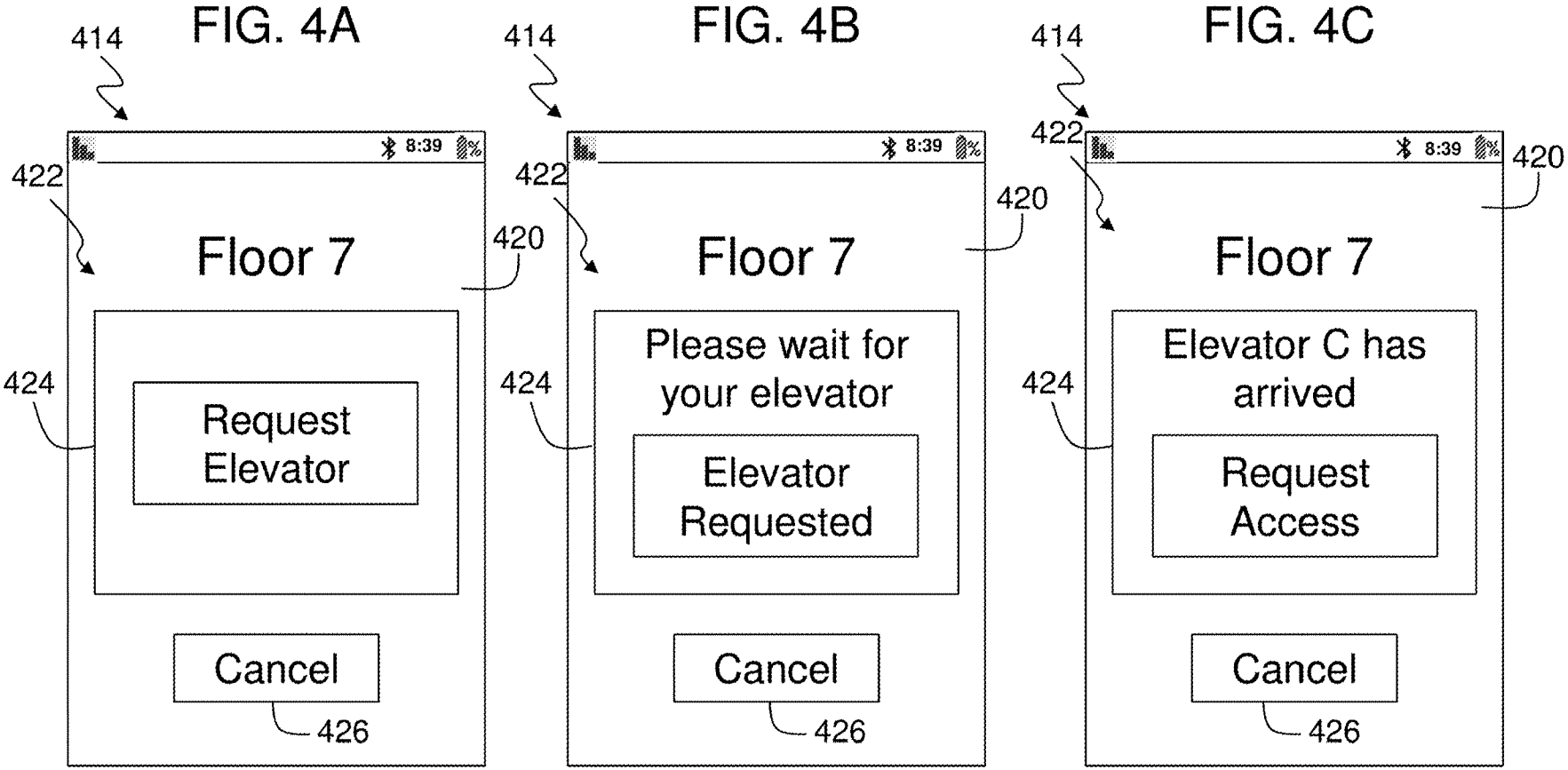
FIG. 4A is a schematic illustration of a user interface on a user device in accordance with an embodiment of the present disclosure.
FIG. 4B is another schematic illustration of the user interface of FIG. 4A.
FIG. 4C is another schematic illustration of the user interface of FIG. 4A.

Turning now to FIGS. 4A-4C, various schematic illustrations of a user program in accordance with an embodiment of the present disclosure is shown. As shown in FIGS. 4A-4C, a screen 420 of a user device 414 may display a user interface 422 that represents a screen or interface of an application in accordance with an embodiment of the present disclosure. The user interface 422 shows a location of the user (e.g., Floor 7), an information and interaction portion 424, and a cancel button 426. The user interface 422 shown in FIG. 4A may represent a display of an application when a user first opens the application on the user device 414. As shown in FIG. 4A, the information and interaction portion 424 displays a button or icon for requesting an elevator.

When a user selects to request an elevator, the view shown in FIG. 4B is presented on the user device 414. The request may be a request by a user to request and reserve an elevator car for traveling from floor 7 within a building. As shown, a notification that the request has been made, and the user is instructed to wait for their elevator to arrive. In some embodiments, the user may be able to select one of a number of elevators, i.e., the user may be able to reserve a specific elevator. In other embodiments, the user may request reservation of one elevator and may not need to specify a specific elevator or elevator car. As such, if a user requests a specific elevator, the wait time for the elevator to be reserved and/or arrive may be longer than requesting any elevator for use. However, requesting a specific elevator may be beneficial in that a user may request an elevator that is closest to a particular location, such as an elevator that is close to a meeting room or one closest to a lobby or other entrance.

As shown in FIG. 4C, when the elevator arrives, the application will display that the elevator is present and display an icon or button that the user may press within the information and interaction portion 424. For example, when the elevator arrives, the elevator car doors may not open, and thus a user may not know specifically that the elevator is waiting. However, the notification on the user's user device notifies the user of the presence of the elevator and that they may press the button to open the doors and enter the elevator car. Further, the notification may indicate the specific elevator that is reserved and waiting with the door closed. For example, when the elevator that is requested is at the proper location, the elevator car doors are closed, and a user may not know which elevator is the correct one. Thus, the notification may provide an indicator, such as elevator number or elevator location, to assist a user in entering the correct requested elevator. For example, as shown in FIG. 4C, "Elevator C" is indicated as having arrived and is ready for the use of the user. As will be appreciated by those of skill in the art, the elevator identifier may be any alphanumeric indicator used to differentiate one elevator from other elevators in an elevator system. For example, the indicator may be letters (e.g., A, B, C, D, etc.) or numbers (e.g., 1, 2, 3, etc.) and/or may be multiple digits of alphanumeric characters such as 'A1,' 'A2,' or 'BA,' 'BB,' or other combinations.

Advantageously, this may enable a user to reserve an elevator and then enter the elevator only when the user is ready, and there may be no confusion of which elevator the user is to board. Moreover, other persons may not be able to enter the elevator car that is explicitly reserved for the user. For example, the user may be a VIP, such as a politician or other person that may require privacy and ease of movement within a building, and thus a reservation of the elevator car for their use may be beneficial such that the VIP may not need to wait for an elevator car, and further the VIP may not have a concern that other persons may enter the reserved elevator car.

In some embodiments, the user may input a desired destination floor through the user interface 422. Thus, when the user enters the elevator, after requesting access (and opening the doors), the user may be transported to a desired floor without the user having to further interact with the elevator car or controllers thereof.

As noted above, access rights for the owner of the user device may be provided when the user device is registered with building management, i.e., the particular user device may be entered into a general system associated with the building. In some embodiments, the user device may be registered with a computing system (e.g., computing systems 200, 300). When the elevator arrives at the specific requested floor, the computing system may send a message or notification to the user device and the elevator car is controlled to wait with the doors fully closed. The user of the user device may acknowledge that the user is ready to board the elevator by pressing a button presented on the user device. The elevator doors will then open and the user may travel to a destination that is already entered via the user device.

In some embodiments, the requesting floor may be defined and instructed from the user device. For example, a user may take the stairs for a number of flights and desire an elevator to be waiting on a particular floor that is different from the user's current floor.

As noted, the elevator car doors do not open until instructed by an input on a user device. That is, the elevator car is controller to travel to a designated floor, but is controlled such that the elevator car doors do not open upon arrival, as is the traditional case for elevators traveling between floors. That is, in accordance with various embodiments provided herein, the controller may impart a delay in the opening of the elevator car doors. Accordingly, in some embodiments, the system may reserve an elevator to be provided to a user and prevents other users from entering the elevator by not opening the elevator car doors until instructed by the user.

In some embodiments, a maximum time of reservation may be employed by the system such that if the user does not request access (i.e., does not send an instruction to open the elevator car doors) the system may automatically cancel the reservation and release the elevator for normal use. If an automatic cancellation occurs, a notification may be sent from the elevator control system to the user device to notify the user that the reservation has been canceled.

Further, as shown in FIGS. 4A-4C, the user interface/application on the user device may present a cancellation option such that the user may cancel an elevator request/reservation at any time. Moreover, in some embodiments, the application/user device may enable a user to set a period time for holding the reservation and/or may allow a user to set a predetermined time in the future for when the reservation of the elevator may begin. For example, a user may have a meeting that ends at 5 pm, and thus the user may request an elevator to be reserved starting at 4:59 pm and may be held for five minutes, such that the user may have an elevator waiting at a desired floor during that time period.

Figure 5:
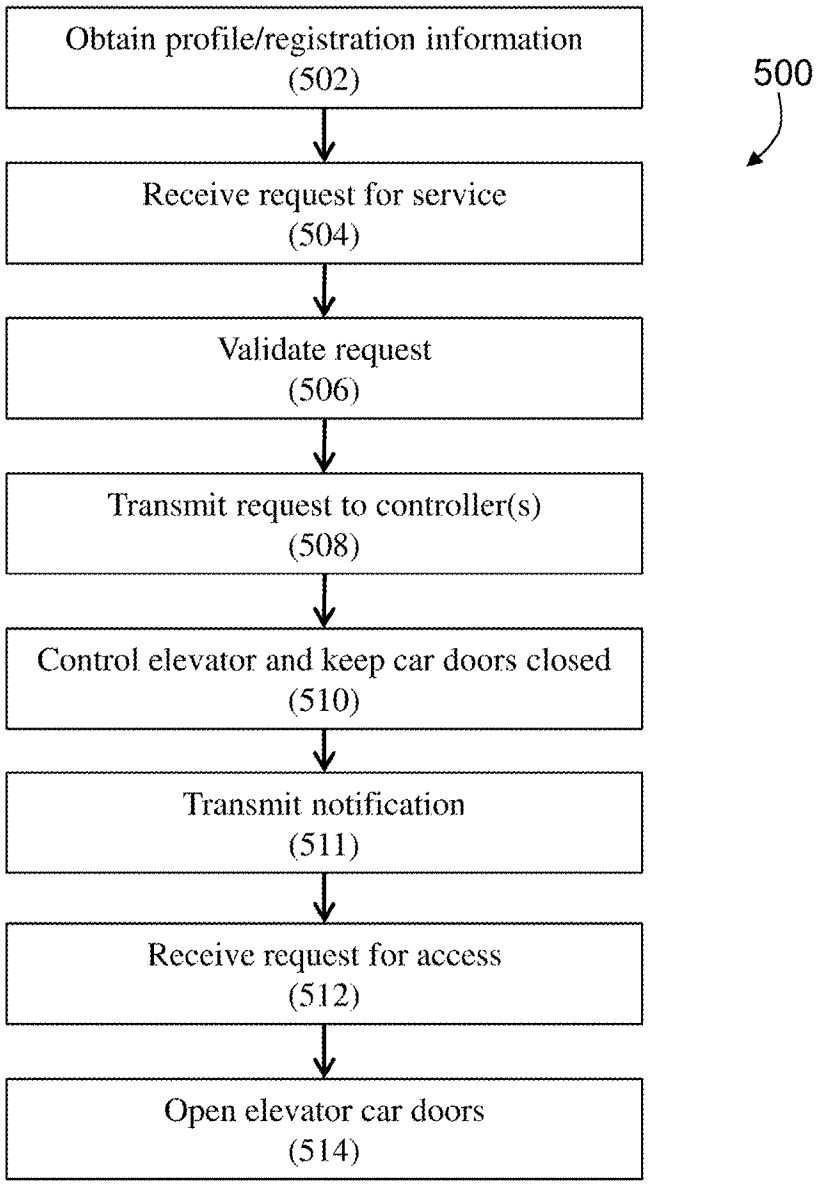
FIG. 5 illustrates a flow process for controlling an elevator system in accordance with an embodiment of the present disclosure.

Referring now to FIG. 5, a flow process of a method 500 is shown that may be used in connection with one or more entities, devices, or systems, such as those described herein. The process 500 may be used to fulfill a request and reservation of an elevator car for service received from a user device over one or more networks.

In block 502, profile and registration information may be obtained. The profile information may be obtained as part of a registration process. The profile information may include one or more of: an identifier associated with a user device, a nickname associated with the user device or a user of the user device, preferences associated with a user of the user device, patterns of usage of an elevator system, etc. As part of block 302, a registration or profile may be received for the service or system itself. The information retrieved at block 302 may be performed when the system is turned on, and the information may be loaded and/or stored in a memory of the system. The information may further include a list of preferred or VIP users and/or user devices, such that the reservation functionality described herein may be carried out.

In block 504, a request for service may be received. The request may be transmitted from a user device that is registered with the system and identified in the profile and/or registration information obtained in block 502. The request for service may include information related to the requesting user device or user, a desired floor to have an elevator car waiting, a desired destination floor to travel to, a time when the reservation is to begin, a duration of the reservation, and/or other information or subsets thereof.

In block 506, the request may be validated. As part of the validation, the request may be approved, partially approved, denied/rejected, or a counter-proposal may be transmitted to a requester or requesting user device modifying one or more terms of the requested service. As part of block 506, a status message or the like may be transmitted to a user device advising of the status of the validation. For example, a notification that the elevator has been requested may be transmitted from the elevator control system to the user device that made the request.

In block 508, approved (or partially approved) requests for service, potentially subject to processing, may be transmitted or forwarded to, e.g., one or more elevator controllers such that an elevator car may be controlled to accommodate the request. For example, the controller(s) may schedule resource(s) to fulfill the service request of block 504. For example, in the context of an elevator system, an elevator bank or elevator car call may be made to summon an elevator car to a particular floor or landing to pick-up a user or passenger in accordance with the request.

At block 510, the elevator control system may control an elevator car to move the elevator car to an indicated floor and further hold the elevator at the indicated floor with the elevator car doors closed. In some embodiments, the elevator car may be held at the particular requested location for a predetermined duration of time. In some embodiments the predetermined duration of time may be user-defined, and in other embodiments, the predetermined duration of time may be set by or controlled by the elevator control system.

At block 511, the elevator control system may transmit a notification to the requesting user device that the elevator has arrived and/or is reserved, that is a notification may be sent regarding elevator availability. In some embodiments, the notification may include an indication of which specific elevator has arrived and/or is reserved. In some embodiments, if a specific elevator is requested, e.g., based on location or otherwise, the notification may indicate that the specific requested elevator has arrived and/or is available for use by the user.

At block 512, the elevator control system may receive a request from the user device that the user has requested access. That is, the system may receive a request for access from the user device, i.e., an authorized user device that is validated.

Upon receiving a request for access at block 512, the elevator control system may control the elevator doors to open and allow a user to enter the elevator car.

In some embodiments, the elevator control system may then control the elevator car to travel to a predetermined location, such as one that was identified in the request for service (block 504).

The flow process 500 is illustrative. In some embodiments, one or more of the blocks or operations (or portions thereof) may be optional. In some embodiments, additional operations not shown may be included. In some embodiments, the operations may execute in an order or sequence different from what is shown. In some embodiments, a user of a mobile wireless programmable device may request a service within or outside of a building or facility.

In some embodiments, requests for service may be scheduled in advance of when needed. In this manner, service can be provided more efficiently (e.g., wait times for fulfilling service requests may be reduced or minimized). In some embodiments, a request for service may be entered on a user device, such as a mobile device. Thus, a user might not be required to touch public devices located within a building or facility, thereby promoting health/hygiene.

In some embodiments, such as embodiments where a profile is maintained for a user or a user device, customized or tailored services may be provided. For example, a very important person (VIP) may receive upgraded services, such as his/her own elevator car to travel to a destination floor or landing of his/her choosing, and the reservation and holding features described herein.

As described above, UDP and/or TCP protocols may be used. Such protocols may provide a low overhead cost of operation of a mobile device connecting to an elevator group. More generally, aspects of the disclosure may be implemented in connection with existing infrastructure, thereby reducing cost and allowing for efficient installation into new or existing facilities or buildings. This allows for the opportunity for service upgrades or enhancements to accommodate wireless device-based services.

In some embodiments, one or more fees may be charged to enable or provide a particular service. In some embodiments, services may be provided for specified durations or times. If a user wishes to use a service beyond the specified duration/time, the user may be required to pay a fee for such extended service opportunities. For example, a minimum duration of holding an elevator car may be preset within a system, and a user may pay to have an elevator held for a longer duration of time.

In some embodiments, services may be targeted to elevator maintenance and facility staff, e.g., security, cleaning, management, etc.

Aspects of the disclosure may be used in connection with one or more data mining applications. For example, patterns of elevator usage may be analyzed to suggest alternative times that users could consume elevator resources. Advertising opportunities may be available. For example, if a user profile indicates that the user likes to drink coffee, coupons for free coffee may be provided to the user as an incentive to utilize the elevator during off-peak times or periods.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method comprising:

storing, with a computing device having a processor and a memory, profile and/or registration information associated with a plurality of user devices;

receiving, by the computing device, a service request for at least one service associated with an elevator system from a user device, wherein the service request includes information of a user-defined departure floor and a user-defined destination floor associated with the service request as input by the user on the user device wherein the user-defined departure floor and the user-defined destination floor is included in the service request from the user device;

validating the service request based on device information in the service request and the profile and/or registration information;

controlling an elevator car to travel to the departure floor in accordance with the service request in response to the validation;

controlling an elevator car door to be closed upon arrival of the elevator car at the departure floor;

transmitting an indicator of the elevator car to the user device that the elevator car has arrived at the departure floor;

presenting on the user device an information and interaction portion including the indicator of the elevator car and an icon for accessing the elevator car;

upon selection of the icon on the user device, receiving an access request from the user device indicating access to the elevator car is requested; and controlling the elevator car door to open upon validation of the access request from the user device.

2. The method of claim 1, wherein the device information comprises at least one of location of the user device and an identifier associated with the user device.

3. The method of claim 1, wherein the service request includes location information of the user device.

4. The method of claim 1, further comprising releasing the elevator car when the access request is not received within a predetermined period of time.

5. The method of claim 4, wherein the predetermined period of time is contained within the service request.

6. The method of claim 1, wherein the indicator indicates a specific elevator has arrived.

7. The method of claim 1, wherein the service request identifies a specific elevator to be used and wherein the controlled elevator car is the specific elevator.

8. A controller for an elevator system, the controller comprising:

at least one processor and a memory, wherein profile and/or registration information associated with a plurality of user devices is stored in the memory; and the memory having instructions stored thereon that, when executed by the at least one processor, cause the controller to:

validate a service request received from a user device based on device information and the profile and/or registration information, wherein the service request includes information of a user-defined departure floor and a user-defined destination floor associated with the service request as input by the user on the user device, wherein the user-defined departure floor and the user-defined destination floor is included in the service request from the user device;

control an elevator car to travel to the departure floor in response to validation of the service request for at least one service associated with the elevator system received from the user device;

control an elevator car door to be closed upon arrival of the elevator car at the departure floor;

transmit an indicator of the elevator car to the user device that the elevator car has arrived at the departure floor;

present on the user device an information and interaction portion including the indicator of the elevator car and an icon for accessing the elevator car;

upon selection of the icon on the user device, receive an access request from the user device indicating access to the elevator car is requested; and control the elevator car door to open upon validation of the access request from the user device.

9. The controller of claim 8, wherein the device information comprises at least one of location of the user device and an identifier associated with the user device.

10. The controller of claim 8, wherein the service request includes location information of the user device.

11. The controller of claim 8, wherein, when the access request is not received within a predetermined period of time, the controller is configured to release the elevator car.

12. The controller of claim 8, wherein the indicator indicates a specific elevator has arrived.

13. The controller of claim 8, wherein service request identifies a specific elevator to be used and wherein the controlled elevator car is the specific elevator.

* * * * *